US005894798A

United States Patent [19]

Miyoshi et al.

[11] Patent Number: 5,894,798

[45] Date of Patent: Apr. 20, 1999

[54] INK FOUNTAIN DIVIDER FOR INK FOUNTAIN ARRANGEMENT

[75] Inventors: Masahiko Miyoshi; Yukitosi Takahashi, both of Kanagawa, Japan

[73] Assignee: Kabushiki Kaisha Tokyo Kikai Seisakusho, Tokyo, Japan

[21] Appl. No.: 08/980,689

[22] Filed: Dec. 1, 1997

[30] Foreign Application Priority Data

May 15, 1997 [JP] Japan ..... 9-125274

[51] Int. Cl.[6] ..... B41F 31/02; B41F 31/06

[52] U.S. Cl. ..... 101/363; 101/208

[58] Field of Search ..... 101/363, 364, 101/365, 366, 350.1, 350.2, 350.6, 356, 360, 207, 208, 210, 148; 118/259, 261

[56] References Cited

U.S. PATENT DOCUMENTS

| | | | |
|---|---|---|---|
| 3,635,161 | 1/1972 | Leanna | 101/364 |
| 3,831,517 | 8/1974 | Wagner | 101/208 |

FOREIGN PATENT DOCUMENTS

| | | |
|---|---|---|
| 13-18722 | 10/1936 | Japan . |
| 50-13123 | 4/1975 | Japan . |
| 50-34089 | 10/1975 | Japan . |

*Primary Examiner*—J. Reed Fisher
*Attorney, Agent, or Firm*—Frishauf, Holtz, Goodman, Langer & Chick

[57] ABSTRACT

An ink fountain divider, which is capable of completely preventing leakage of ink and is easy to handle, includes an ink fountain divider body which has an approximately triangular shaped cross-section having a bottom edge having a contour line conforming with the outer peripheral surface of the ink fountain roller, and another edge having a contour line conforming with the an upper surface of the bottom plate, having a given width in a direction parallel to an axis of the ink fountain roller. The ink fountain divider body is formed of a non-magnetic material having a hardness smaller than that of a material forming the outer peripheral surface of the ink fountain roller. The ink fountain divider body contacts with the bottom plate of the ink fountain arrangement for dividing an ink storage space in the ink fountain arrangement. A magnetically attracting device is integrally provided within the ink fountain divider body in integral fashion therewith in a condition exposing a magnetically attracting surface in the lower surface of the ink fountain divider body without projecting from the lower surface and with exposing a switching portion on the upper surface thereof for selectively switching generation and extinguishing a magnetic force for firmly fitting the lower surface of the ink fountain divider body onto the bottom plate, for selectively generating and extinguishing the magnetic force.

6 Claims, 3 Drawing Sheets

INK FOUNTAIN DIVIDER FOR INK FOUNTAIN ARRANGEMENT

BACKGROUND OF THE INVENTION

1. Field of the Invention

The present invention relates to an ink fountain divider for an ink fountain arrangement as an ink supply device for a printing press, which is located adapting to a printing region to be used and can store an ink efficiently.

2. Description of the Related Art

Ink fountain dividers for ink fountain arrangements have been disclosed in Japanese Examined Utility Model Publication (Kokoku) No. Showa 50-13123 for "Ink Gate for Rotary Press", Japanese Examined Utility Model Publication No. Showa 50-34089 for "Ink Arrangement for Printing Press" and Japanese Examined Patent Publication No. Showa 36-18722 for "Liquid Vessel Divider".

The "Ink Gate for Rotary Press" disclosed in Japanese Examined Utility Model Publication No. Showa 50-13123, which is used by being placed above an ink flow rate adjusting plate movable for adjusting a gap between an ink fountain and an ink fountain roller, is typically constructed in such a manner that an ink gate body is formed of lead or the like into a cross-sectionally substantially triangular shaped configuration, a magnet is buried in the ink gate body with exposing a magnetic surface on the bottom of the ink gate body, a frame piece of elastic material, such as rubber or the like, is bonded on the outer periphery of the bottom of the ink gate body, and a contact piece of elastic material is bonded on the side contacting with the ink fountain roller. The contact piece is formed with a curved surface for contacting with a part of the outer peripheral surface of the ink fountain roller. The curved surface is formed with a plurality of ridges having a saw-tooth like cross-section and extending in spiral fashion so as to provide frictional resistance against rotation of the ink fountain roller.

The ink gate is magnetically secured on the ink flow rate adjusting plate by the magnet buried in the ink gate body to certainly place at fixed position and maintain thereat so that the lower surface of the frame piece and the lower surface of the contact piece are firmly contacted with the ink flow rate adjusting plate to prevent the ink from causing leakage. On the other hand, the peak portions of respective spiral ridges forming the curved surface of the contact piece are kept in contact with the outer periphery of the ink fountain roller and, when the ink fountain roller is driven to rotate for feeding the ink, respective ridges keep frictional contact with the outer periphery of the ink fountain roller to be pulled in spiral direction to make the lower tip ends thereto to penetrate into a gap defined between the ink fountain roller and the ink flow rate adjusting plate, and in conjunction therewith, the curved surface of the contact piece keeps firm contact with the outer peripheral surface of the contact piece for preventing leakage of the ink.

On the other hand, in the construction of the "Ink Arrangement of Printing Press" as disclosed in Japanese Examined Utility Model Publication No. Showa 50-34089, an ink gate to be placed on an ink doctor forming a bottom plate of the ink arrangement in an ink supply device, in which adjustment of a gap with respect to the ink fountain roller is performed by deforming the ink doctor in a direction of angular displacement by pushing up an adjusting screw, is formed with an ink gate body formed of an elastic rubber for conformability and for avoiding damaging of the ink doctor and the ink fountain roller, and a rubber magnet plate is mounted at the portion mating with the ink doctor. When adjustment is made by pushing up the ink doctor, the ink gate formed of rubber and the rubber magnet plate bonded on the lower surface of the ink gate may be deformed in conformance with deformation of the ink doctor to keep firm contact with the latter over the entire contacting surface to successfully prevent leakage of the ink.

Also, "Liquid Vessel Divider" disclosed in Japanese Examined Patent Publication No. Showa 36-18722 is an ink fountain divider which is disposed in an ink vessel perpendicularly to the ink vessel and an ink vessel roller. A sealing elastic plate of an elastic material, such as rubber or the like, for preventing leakage of the ink is clamped by side plates at both sides. A metallic pressure plate which is formed into a shape conforming with the shapes of the ink vessel roller and the inner wall of the ink vessel, is provided on the periphery of the inside of the sealing elastic plate for depressing the sealing elastic plate onto the ink vessel roller and the inner wall of the ink vessel by a uniform pressure. Also, on the opposite side of the sealing elastic plate across the metallic pressure plate, a connecting member is provided at a position distanced from the metallic pressure plate substantially equal distance to that of the sealing elastic plate. A plurality of compression springs are mounted between the metallic pressure plate and the connecting member for depressing the metallic plate with a regular interval. A mounting hook and clamp are connected to one end of the connecting member for placing the ink fountain divider at desired position in the ink vessel.

Once the ink fountain divider is fixed within the ink vessel by means of the mounting hook and the clamp, the sealing elastic plate contacts with the ink vessel roller and the inner wall of the ink vessel to be pushed back against the compression spring. Associating therewith, the sealing elastic plate is pushed outwardly via the metallic pressure plate by reactive force of the compression springs. By this, the ink fountain divider can firmly contact with the ink vessel roller and the bottom plate of the ink vessel to prevent leakage of the ink.

The foregoing prior arts hold several drawbacks to be solved. Namely, in the "Ink Gate for Rotary Press" as disclosed in Japanese Examined Utility Model Publication No. Showa 50-13123, the magnet is buried in the ink gate body formed of lead or the like, the frame pieces of elastic material is bonded on the outer periphery of the bottom surface, and the contact piece of elastic material, such as rubber or the like, formed with a plurality of ridges formed into spiral fashion for contacting with the ink fountain roller as rotated, on the side contacting with the ink fountain roller.

Since the ink gate is used by positioning on the ink flow rate adjusting plate for adjusting gap defined between the ink fountain roller, a pressure is applied to the contact piece having a plurality of ridges extending in spiral fashion with the curved surface formed with the elastic material on the side contacting with the ink fountain roller for constantly keeping frictional contact on the outer peripheral surface of the ink fountain roller even when the ink gate is shifted, for preventing leakage of the ink. However, since the contact piece of elastic material, such as rubber or the like is constantly kept in frictional contact with the rotary body, i.e. the ink fountain roller, the portion of the contact piece contacting with the rotary body can be quickly worn to shorten the life of the product. On the other hand, the force contacting the ink gate onto the ink flow rate adjusting plate is determined by the weight of the lead or the like as own weight and a magnetic force of the magnet buried in the lower surface. However, the force is not large for permitting mounting and releasing of the ink gate by a worker. When the stored ink is stirred by the ink gate, the ink gate is subject to the pressure from the ink being stirred and the spiral ridges at the tip end of the contact piece are subject to frictional resistance in the spiral direction by rotation of the ink fountain roller to possibly cause displacement of the ink fountain roller in a direction widening the ink storage region to be a cause of ink leakage. Also, since the ink gate is formed of relatively heavy material, such as lead or the like, work load in mounting, releasing and transporting on the worker becomes heavy to possibly cause damage on the shoulder, lumbar area or so forth. Furthermore, the ink gate can be dropped down from the worker's hand due to heavy, thus requiring other safety measures.

On the other hand, in "Ink Arrangement for Printing Press" disclosed in Japanese Examined Utility Model Publication No. Showa 50-34089, adjustment of the ink flow rate is performed by deforming the ink doctor in the direction of angular displacement. The ink arrangement includes the ink gate body made of an elastic body having flexibility conformable with deformation of the ink doctor, and the ink gate means of the rubber magnet mounted on the lower surface of the ink gate.

The ink gate body is formed of rubber having elasticity for high conformability with the ink doctor and not damaging the ink fountain roller. According to deformation of the ink doctor, the ink gate body is also deformed in conformance therewith to contact with the ink fountain roller under pressure. Therefore, the portion of the ink gate body contacting with the ink fountain roller is quickly worn to shorten the product life. The force to keep the ink gate contact with the ink doctor is only magnetic force of the rubber magnet mounted on the lower surface of the ink gate, which force is in a magnitude permitting mounting and releasing of the ink gate by worker. When the stored ink is stirred by the ink gate means, the ink gate is displaced in the axial direction of the ink fountain roller in the direction of widening the ink storage region by the pressure exerted by the stirred ink to be a cause of ink leakage.

Furthermore, in "Liquid Vessel Divider" disclosed in Japanese Unexamined Patent Publication No. Showa 36-18722, the ink fountain divider is disposed within the ink vessel substantially perpendicularly to the ink vessel and the axis of the ink vessel roller to firmly contact therewith to avoid ink leakage. The ink fountain divider prevents leakage of the ink by outwardly pushing the sealing elastic plate located outside and formed of elastic material, such as rubber or the like, by a pressurizing mechanism constituted of the connecting member disposed within the ink fountain divider, the compression springs and the metallic pressure plate.

The sealing elastic plate of the ink fountain divider is formed of elastic material, such as rubber or the like and is constantly contacted with the ink vessel roller to be quickly worn to shorten the product life. Also, the pressurizing mechanism for the sealing elastic plate is constructed with the connecting member, the compression springs and the metallic pressure plate and thus is complicated in structure, requires a large number of parts resulting in high cost. Furthermore, possibility of occurrence of failure is high.

SUMMARY OF THE INVENTION

The present invention has been worked out for solving the problems in the prior art as set forth above. Therefore, it is an object of the present invention to provide an ink fountain divider which can establish firm contact with an ink fountain arrangement with large contacting force and thereby can completely prevent an ink from causing leakage, and is, in turn, light in weight and easy in installation and removal.

Another object of the present invention is to provide an ink fountain divider which has a smooth surface to permit uniform contact with a surface of an ink fountain roller with restricting wearing.

A further object of the present invention is to provide an ink fountain divider which achieves high operability in installation and removal with respect to the ink fountain arrangement, and has a simple structure with a lesser number of parts.

According to one aspect of the invention, an ink fountain divider for an ink fountain including an ink fountain roller, an ink supply amount adjusting means for adjusting a gap relative to an outer peripheral surface of the ink fountain roller, a thin plate form bottom plate of a magnetic material covering an upper surface of the ink supply amount adjusting means, comprises:

an ink fountain divider body having an approximately triangular shaped cross-section having a bottom edge having a contour line conforming with the outer peripheral surface of the ink fountain roller, another edge having a contour line conforming with an upper surface of the bottom plate, having a given width in a direction parallel to an axis of the ink fountain roller, the ink fountain divider body being formed of a non-magnetic material having a hardness smaller than that of a material forming the outer peripheral surface of the ink fountain roller, and the ink fountain divider body contacting with the bottom plate of the ink fountain arrangement for dividing an ink storage space in the ink fountain arrangement; and a magnetically attracting means integrally provided within the ink fountain divider body in integral fashion therewith in a condition exposing a magnetically attracting surface in the lower surface of the ink fountain divider body without projecting from the lower surface and with exposing a switching portion on the upper surface thereof for selectively switching generation and extinguishing of a magnetic force for firmly fitting the lower surface of the ink fountain divider body onto the bottom plate, for selectively generating and extinguishing the magnetic force.

In the construction, a handle to be used in handling of the ink fountain divider body may be provided on the upper surface of the ink fountain divider body. The ink fountain divider body may be formed of a synthetic resin. A source of magnetic force of the magnetically attracting means may be a permanent magnet.

The ink fountain divider body is switched the switching portion on the side generating the magnetic force in the condition contacting with the bottom plate of the ink fountain arrangement to be attracted toward the bottom plate by the magnetically attracting means. By switching the switching portion on the magnetic force extinguishing side, attracting force between the ink fountain divider and the bottom plate is extinguished to facilitate removal of the ink fountain divider from the ink fountain arrangement. Furthermore, handling of the ink fountain divider can be performed by gripping the handle.

BRIEF DESCRIPTION OF THE DRAWINGS

The present invention will be understood more fully from the detailed description given herebelow and from the accompanying drawings of the preferred embodiment of the present invention, which, however, should not be taken to be limitative to the invention, but are for explanation and understanding only.

In the drawings.

DESCRIPTION OF THE PREFERRED EMBODIMENT

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instances, well-known structures are not shown in detail in order to avoid unnecessary obscuring of the present invention.

Figure 1:
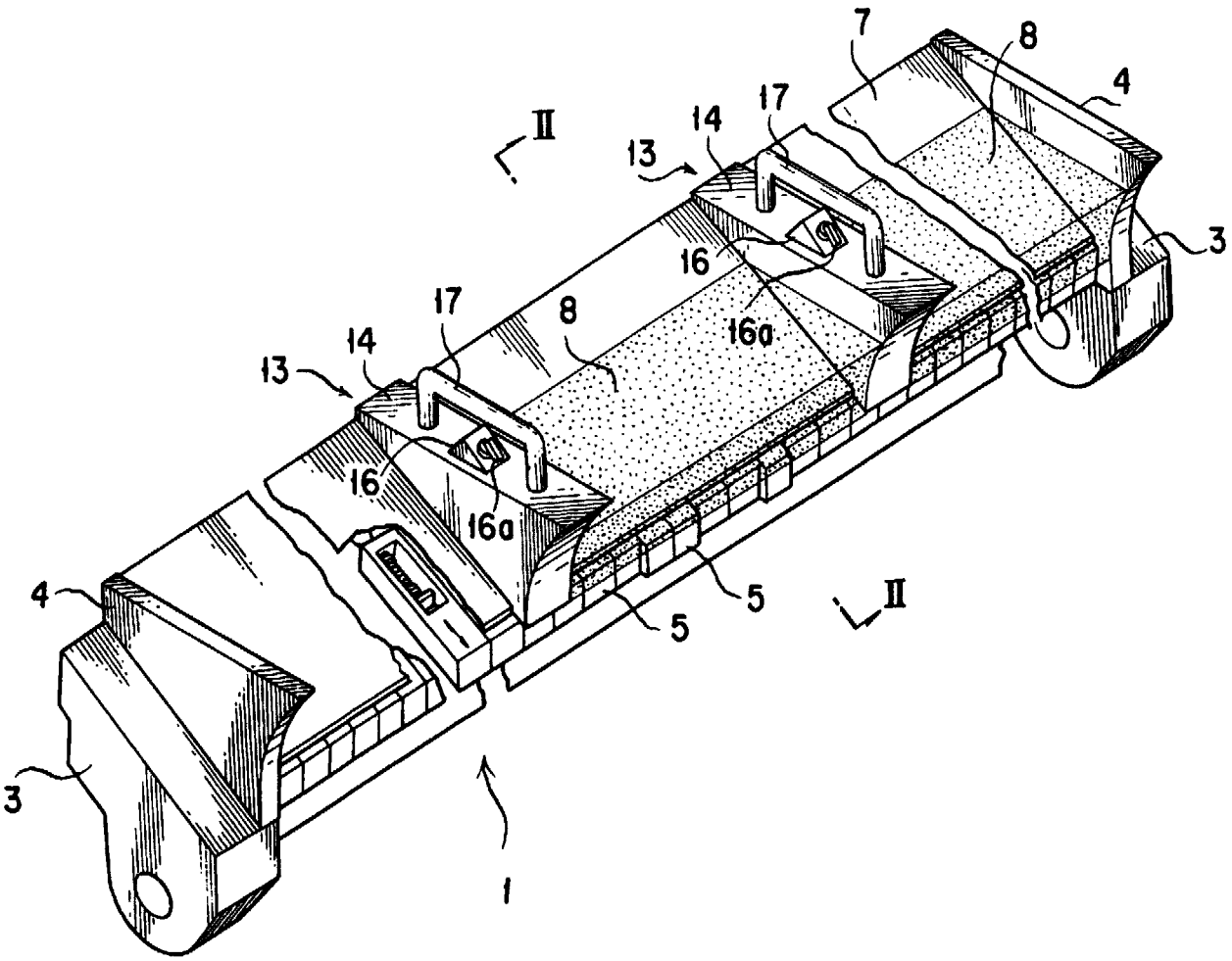
FIG. 1 is a perspective view showing a preferred embodiment of an ink fountain divider according to the present invention for dividing an ink fountain arrangement into a plurality of compartments for use of a part of the ink fountain arrangement.
Figure 2:
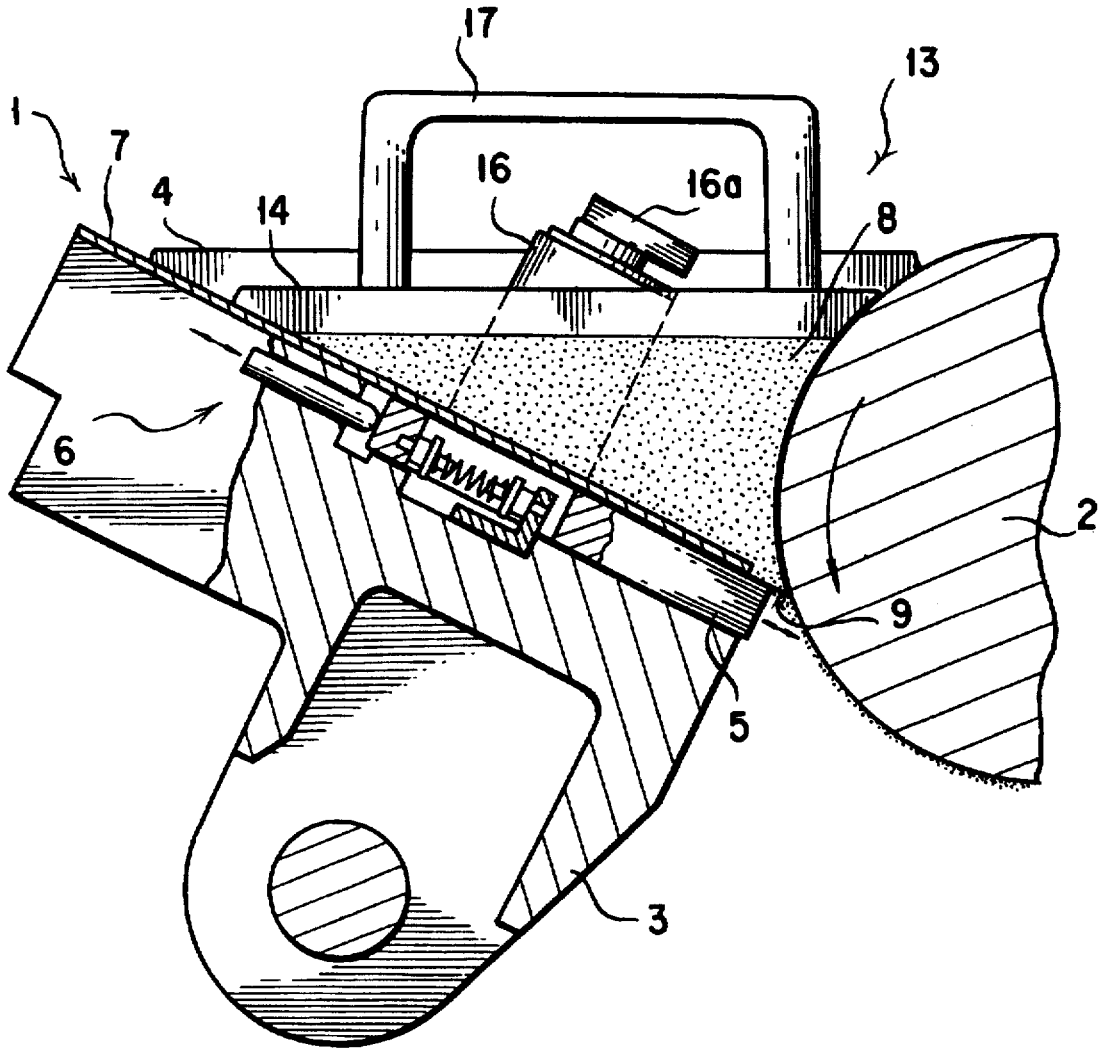
FIG. 2 is a section taken along line II—II of FIG. 1.
Figure 3:
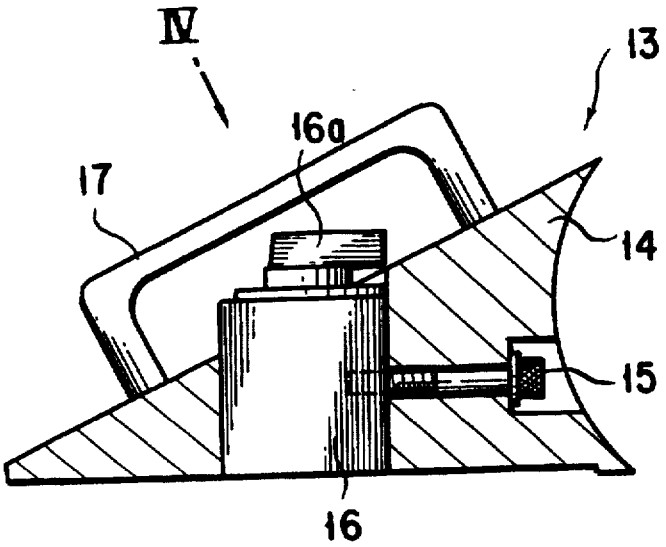
FIG. 3 is a section of the preferred embodiment of the ink fountain divider according to the invention.
Figure 4:
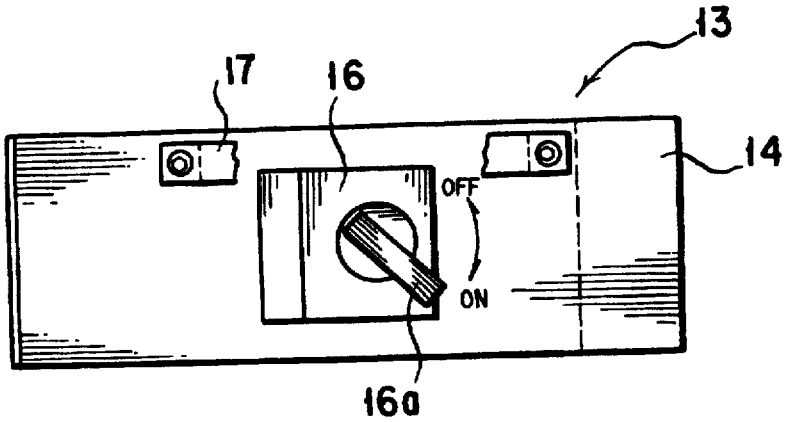
FIG. 4 is an illustration of the preferred embodiment of the ink fountain divider as viewed along an arrow IV in FIG. 3.

Referring now to the drawings, FIG. 1 is a perspective view showing a preferred embodiment of an ink fountain divider according to the present invention for dividing an ink fountain arrangement into a plurality of compartments for use as a part of the ink fountain arrangement, FIG. 2 is a section taken along line II—II of FIG. 1, FIG. 3 is a section of the preferred embodiment of the ink fountain divider according to the invention, and FIG. 4 is an illustration of the preferred embodiment of the ink fountain divider as viewed along an arrow IV in FIG. 3.

An ink fountain arrangement 1 shown in FIGS. 1 and 2 includes a base 3 descending toward an outer peripheral surface of an ink fountain roller 2 which is driven to rotate in a direction shown by an arrow (counterclockwise direction in FIG. 2) by a not shown driving means, side plates 4, defining both sides of a groove defined by the outer periphery of the ink fountain roller 2, a plurality of dividing blades 5 . . . arranged for movement along a tapered upper surface of the base 3, a plurality of ink supply amount adjusting means 6 . . . (shown only a part) for linearly shifting the respective dividing blades 5 . . . along a longitudinal axis by a not shown driving means, and a thin plate form bottom plate 7 of a magnetic material covering upper surfaces of the ink supply amount adjusting means 6 . . . and the dividing blades 5 and being fixed on the base 3. The upper portion of the ink fountain arrangement 1 is opened to store an ink 8 within a groove. Between an upper edge of the side of respective dividing blades 5 . . . , located in the vicinity of the ink fountain roller 2 and the outer peripheral surface of the ink fountain roller 2, a gap 9 is defined so that the ink deposited on the outer peripheral surface of the ink fountain roller 2 is drawn through the gap 9 by rotation of the ink fountain roller 2.

In the ink fountain arrangement 1 of the known construction as set forth above, the preferred embodiment of an ink fountain divider 13 according to the present invention is used upon performing printing with a plate which has a printing image located only a partial region of a plate cylinder in the axial direction. As shown in FIG. 1, on the bottom plate 7 of the ink fountain arrangement 1, the ink fountain dividers 13, are set at both sides of a portion aligned with a region of the printing image on the plate of the plate cylinder. Then, printing operation is performed with storing the ink 8 within a region defined between the ink fountain dividers 13. In the alternative, it is also possible to perform printing with storing the ink 8 within a region defined between one of the side plates 4 and the adjacent ink fountain divider 13.

As shown in FIGS. 3 and 4, the ink fountain divider 13 has an appropriate width in a direction parallel to an axis of the ink fountain roller 2. The ink fountain divider 13 is formed into substantially isosceles triangular configuration and the bottom edge, i.e. the front surface, is formed with a curved concave surface conforming with the outer peripheral surface of the ink fountain roller 2. One of remaining two edges, namely the lower surface is formed into a smooth surface adapting the shape of the bottom plate 7 firmly contacting with the bottom plate 7 of the ink fountain arrangement 1. The ink fountain divider 13 is constructed with a light weight ink fountain divider body 14 of a synthetic resin having low rigidity so as not to injure the outer peripheral surface of the ink fountain roller 2, a magnetically attracting means 16 rigidly fixed at the center portion of the ink fountain divider body 14 by means of bolt 15 and buried in the ink fountain divider body 14 with exposing a magnetically attracting surface on the lower surface of the ink fountain divider surface 14 for firmly contacting with the bottom plate 7 of the ink fountain arrangement 1, with exposing a switching portion 16a capable of turning ON and OFF a magnetic force of the magnetically attracting means 16 on the upper surface of the ink fountain divider body 14, and a handle 17 provided on the upper surface of the ink fountain divider body 14 for handling the ink fountain divider 13.

Turning ON and OFF the magnetic force of the magnetically attracting surface of the magnetically attracting means 16 may be performed by changing a phase of a permanent magnet with respect to a magnetic body forming the magnetically attracting surface when a source of a magnetic force is a permanent magnet. In the alternative, when the source of the magnetic force is an electromagnet, turning ON and OFF the magnetic force is turning ON and OFF the power supply for an electromagnetic coil. In the shown embodiment, the magnetically attracting means 16 has the former mechanism (magnetic holder base available from Kanetec K. K., for example).

As shown in FIG. 3, the magnetically attracting means 16 is mounted with mating the lower surface of the ink fountain divider body 14 and the magnetically attracting surface of the magnetically attracting means 16, or, in the alternative, in a condition where the lower surface of the magnetically attracting means 16 is slightly retracted from the lower surface of the ink fountain divider body 14. Thus, the ink fountain divider body 14 and the bottom plate 7 of the ink fountain arrangement 1 are firmly contacted. It should be noted that while the handles 17 in the shown embodiment are illustrated in a form offset toward one side in the axial direction of the ink fountain divider body 14, the handles 17 may be mounted at the center portion in the axial direction of the ink fountain divider body 14 when enough space for turning ON and OFF the magnetic force can be provided.

As shown in FIG. 1, when two ink fountain dividers 13 are used, the respective ink fountain dividers 13 are located at both sides of a region of the desired printing image of the plate for performing printing with storing the ink 8 within the region defined therebetween. In the alternative, when the ink fountain divider 13 and the side plate 4 are used in combination, one ink fountain divider 13 is positioned on the bottom plate 7 of the ink fountain arrangement 1 adapting to the region of the desired printing image of the plate for use with storing the ink.

At first, with turning the switching portion 16*a* for turning ON and OFF the magnetic force of the magnetically attracting means 16 at "OFF", the ink fountain divider 13 is mounted on the bottom plate 7 to place at a position where the ink fountain divider 13 may uniformly contact with the outer peripheral surface of the ink fountain roller 2 and uniformly contact with the bottom plate 7. Then, the switching portion 16*a* for turning ON and OFF the magnetic force of the magnetically attracting means 16 is turned ON. By this, a magnetic attracting force is generated on the magnetically attracting surface of the magnetically attracting means 16, the ink fountain divider 13 is firmly contacted with the bottom plate 7 of the ink fountain 1 with a strong contact force. This setting is performed for each ink fountain divider 13.

During the printing operation, the ink is stored between the ink fountain dividers 13 or between the ink fountain divider 13 and the side plate 4. In the region of the printing image, by displacing the dividing blades 5 . . . by the ink supply amount adjusting means 6 . . . , adjustment of ink supply amount is performed. The bottom plate 7 covering the upper surface of the dividing blades 5 . . . and the ink supply amount adjusting means 6 . . . are fixed on the base 3, and is not influenced by displacement of the dividing blades 5 . . . to be held in fixed position. Similarly, the ink fountain dividers 13 contacting with the bottom plate 7 are not influenced by displacement of the dividing blades 5 . . . . .

The shown embodiment of the ink fountain divider 13 according to the present invention buried within the magnetically attracting means 16 is held in a condition maintaining uniform contact with the outer peripheral surface of the ink fountain roller 2 while the switching means for turning ON and OFF the magnetic force of the magnetically attracting means 16 is held "ON". Thus, unnecessary force will not act on the curved concave surface conforming; with the outer peripheral surface of the ink fountain roller 2 of the ink fountain divider body 14. Therefore, friction is small to prevent leakage of the ink effectively.

When the ink fountain dividers 13 are removed after the printing operation, the switching portion 16*a* on the upper surface of the magnetically attracting means 16 for turning ON and OFF the magnetic force, is turned "OFF". By this, magnetic attracting force of the magnetically attracting surface is extinguished. Thus, the force keeping the ink fountain divider in contact with the ink fountain roller becomes only the weight of the synthetic resin of the ink fountain divider body 14 and the magnetic attracting means 16. Therefore, the load to be handled in removal of the ink fountain divider becomes small to facilitate the removal operation and thus may not cause injury on the shoulder, lumbar area or so forth of the worker. Furthermore, since handles 17 are provided on the upper surface of the ink fountain divider body 14, handling in installation and removal of the ink fountain divider to and from the ink fountain arrangement 1, and handling in transportation of the ink fountain divider can be facilitated. In addition, the possibility of dropping the ink fountain divider can be reduced.

On the other hand, the switching portion 16*a* for turning ON and OFF the magnetic force is provided on the upper surface of the ink fountain divider 13 to facilitate operation. If a plurality of printing images in adjacent positions on the plate and respectively different colors of inks are used, it is possible to perform printing with storing different colors of inks at different sides of the ink fountain divider 13 adapting to the region of the printing image.

When printing is performed with restricting the ink storage region in the ink fountain arrangement 1 utilizing the shown embodiment of the ink fountain divider 13 according to the present invention, a region, on which the ink is deposited, in ink supply, is limited to reduce wasting the ink. Also, since the area of the ink fountain arrangement 1 requiring cleaning after a printing operation can be limited to facilitate the cleaning operation. The preferred embodiment of the ink fountain divider according to the present invention achieves further advantages as set out below, in addition to the effect in the prior art.

As set forth above, by implementation of the present invention, contact of the ink fountain divider onto the ink fountain arrangement can be achieved by generating large magnetic attraction force on the magnetically attracting surface by turning ON the switching portion of the magnetic force. Thus, large contact force for keeping firm contact of the ink fountain divider onto the bottom plate of the ink fountain arrangement, can be maintained. Thus, leakage of the ink can be effectively prevented. On the other hand, removal of the ink fountain divider from the ink fountain arrangement can be done with extinguishing the magnetic attraction force of the magnetically attracting surface by turning "OFF" the switching portion of the magnetic force. Therefore, removal can be done with quite small force.

On the other hand, by using synthetic resin for forming the ink fountain divider body, the ink fountain divider can be formed in light weight to facilitate installation, removal, transportation and so forth so as not to injure shoulder, lumbar area and so forth of the worker. Also, since the surface of the ink fountain divider body is smooth, uniform contact with the ink fountain roller can be maintained to reduce wearing the ink fountain divider body.

Furthermore, since the switching portion of the magnetic force is exposed to the upper surface of the ink fountain divider body, switching operation of turning ON and OFF the magnetically attracting force can be performed easily upon installation and removal from the upper side to provide good operability. Furthermore, the shown embodiment of the ink fountain divider avoids projection on the side surface to provide a neat configuration. As a result, no problem would be encountered even in the case where different colors of inks are stored at both sides of the ink fountain divider. Furthermore, when not in use, the ink fountain divider may be placed adjacent the side plate on one side without interfering with the ink supply for the entire surface of the plate. In addition, the ink fountain divider according to the present invention achieves remarkable effect as set forth above with simplification of structure to lower production cost, to reduce possibility of occurrence of trouble, such as failure or so forth to facilitate maintenance.

Additionally, the construction, in which the handles are provided on the upper surface of the ink fountain divider body, facilitates handling in installation and removal to and from the ink fountain arrangement and in transportation together with reduced weight of the ink fountain divider body, and reduces possibility of dropping from the worker's hand.

Although the present invention has been illustrated and described with respect to exemplary embodiments thereof, it should be understood by those skilled in the art that the foregoing and various other changes, omissions and additions may be made therein and thereto, without departing from the spirit and scope of the present invention. Therefore, the present invention should not be understood as limited to the specific embodiments as set out above but to include all possible embodiments which can be embodied within a scope encompassed and equivalents thereof with respect to the features set out in the appended claims.

What is claimed is:

1. An ink fountain divider for an ink fountain including an ink fountain roller, an ink supply amount adjusting means for adjusting a gap relative to an outer peripheral surface of said ink fountain roller, and a thin plate form bottom plate of a magnetic material covering an upper surface of said ink supply amount adjusting means, further comprising:

an ink fountain divider body having an approximately triangular shaped cross-section which has a bottom edge having a contour line conforming with the outer peripheral surface of said ink fountain roller, and another edge having a contour line conforming with an upper surface of said bottom plate, having a given width in a direction parallel to an axis of said ink fountain roller, said ink fountain divider body being formed of a non-magnetic material having a hardness smaller than that of a material forming the outer peripheral surface of said ink fountain roller, and said ink fountain divider body contacting with said bottom plate of said ink fountain arrangement for dividing an ink storage space in said ink fountain arrangement; and a magnetically attracting means integrally provided within said ink fountain divider body in integral fashion therewith in a condition exposing a magnetically attracting surface in the lower surface of said ink fountain divider body without projecting from said lower surface and with exposing a switching portion on the upper surface thereof for selectively switching generation and extinguishing a magnetic force for firmly fitting the lower surface of said ink fountain divider body onto said bottom plate, for selectively generating and extinguishing the magnetic force.

2. An ink fountain divider for an ink fountain arrangement as set forth in claim 1, wherein a handle to be used in handling of said ink fountain divider body is provided on the upper surface of said ink fountain divider body.

3. An ink fountain divider for an ink fountain arrangement as set forth in claim 1, wherein said ink fountain divider body is formed of a synthetic resin.

4. An ink fountain divider for an ink fountain arrangement as set forth in claim 2, wherein said ink fountain divider body is formed of a synthetic resin.

5. An ink fountain divider for an ink fountain arrangement as set forth in claim 1, wherein a source of magnetic force of said magnetically attracting means is a permanent magnet.

6. An ink fountain divider for an ink fountain arrangement as set forth in claim 2, wherein a source of magnetic force of said magnetically attracting means is a permanent magnet.

* * * * *